United States Patent [19]

Veyrassat

[11] 3,945,580

[45] Mar. 23, 1976

[54] WIRE-WINDING MACHINE

[75] Inventor: Louis Veyrassat, Rolle, Switzerland

[73] Assignee: Maillefer S.A., Switzerland

[22] Filed: Oct. 22, 1974

[21] Appl. No.: 517,030

[30] Foreign Application Priority Data

Oct. 26, 1973 Switzerland ..... 15105/73

[52] U.S. Cl. ..... 242/25 A; 242/25 R

[51] Int. Cl.[2] ..... B65H 67/04

[58] Field of Search..... 242/25 A, 25 R, 18 A, 18 R

[56] References Cited

UNITED STATES PATENTS

| | | | |
|---|---|---|---|
| 1,744,739 | 1/1930 | Blount | 242/25 R X |
| 1,964,530 | 6/1934 | Newton | 242/25 R |
| 3,182,921 | 5/1965 | Nelson | 242/25 A |
| 3,661,335 | 5/1972 | Stefaniszyn | 242/25 A |

*Primary Examiner*—Stanley N. Gilreath
*Attorney, Agent, or Firm*—Stevens, Davis, Miller & Mosher

[57] ABSTRACT

A winding machine for metal wire including apparatus to protect, for example, a reel or wire wound on a reel should feed wire break during feeding of the reel. The apparatus includes: a support for at least one reel; a motor for driving the reel in rotation; a guiding mechanism including a traversing carriage bearing a pulley for guiding the wire as the wire is wound on the reel; and a protective device, to protect the reel in the event of wire breakage, including two protective plates of arcuate shape extending the entire length of the reel. At least one of the plates is hinged about an axis parallel to that of the reel and is movable between an open position and a closed position in which one of its edges meets a corresponding edge of the other of the plates, the opposite edges of the two plates being spaced from one another so as to define a longitudinal slot between them. The slot is adapted to admit the wire when the protective device is in the closed position, and the protective device further includes a sliding, protective member disposed in the slot. The sliding member is carried by the carriage and has a small opening situated in the plane of the pulley and adapted to admit the wire.

7 Claims, 4 Drawing Figures

WIRE-WINDING MACHINE

This invention relates to a winding machine for metal wire comprising a support for at least one reel, means for driving the reel in rotation, and means for guiding the wire being wound on the reel.

The production of insulated or bare metal wire of small diameter requires the use of winding machines operating at increasingly high speeds. Owing to such high speeds, the risk of breakage of the wire during the filling of a reel cannot be entirely eliminated, particularly with fine wire or wire made of low-strength materials such as aluminum, for example. Thus if the wire breaks, the broken end whips about the reel and is liable to damage not only certain parts of the reel but also the layers of wire already wound.

It has hitherto been attempted to remedy these drawbacks by automatically detecting the breaking of the wire and then blocking the reel as quickly as possible. However, this method does not adequately remedy the drawbacks resulting from wire breakage.

It is the object of this invention to provide a means of avoiding as completely as possible the risk of damage to the reel and to the layers already wound in the event of the breakage of a wire being wound on a reel mounted on a winding machine.

To this end, the winding machine according to the present invention further comprises a protective device, intended to protect the reel in the event of wire breakage, comprising two protective plates extending the entire length of the reel, at least one of the plates being hinged about an axis parallel to that of the reel and being movable between an open position and a closed position in which one of its edges meets a corresponding edge of the other plate, the opposite edges of the two plates being spaced from one another so as to define a longitudinal slot between them, and the slot being adapted to admit the wire when the protective device is in the closed position.

The system of protection defined above may be applied to various types of winding machines. The known types include both single-reel winding machines requiring interruption of the wirefeed and stopping of the reel when it is full so that it may be removed and replaced by an empty reel, and several types of socalled double-reel winding machines, i.e., those comprising supporting means for two reels and a transfer device enabling the wire to be guided alternately onto one and then the other of the reels. The extraction of the full reel and its replacement by an empty one then take place while another reel is in the process of being filled.

The protective means defined above may be utilized in all of these cases.

Both the single-reel and double-reel winding machines are generally equipped with a traverse mechanism which, in the case of the double-reel machines, moves with respect to the reel supports so as to cooperate alternately with one or the other of the reels. In a more especially preferred embodiment of this invention, the slot which is formed between the two protective plates to admit the wire, and which extends along the entire length of the reel, is partially closed off by a sliding protective member mounted on the traversing carriage and moving along with it.

A preferred embodiment of the invention will now be described in detail with reference to the accompanying drawings, in which.

Figure 1:
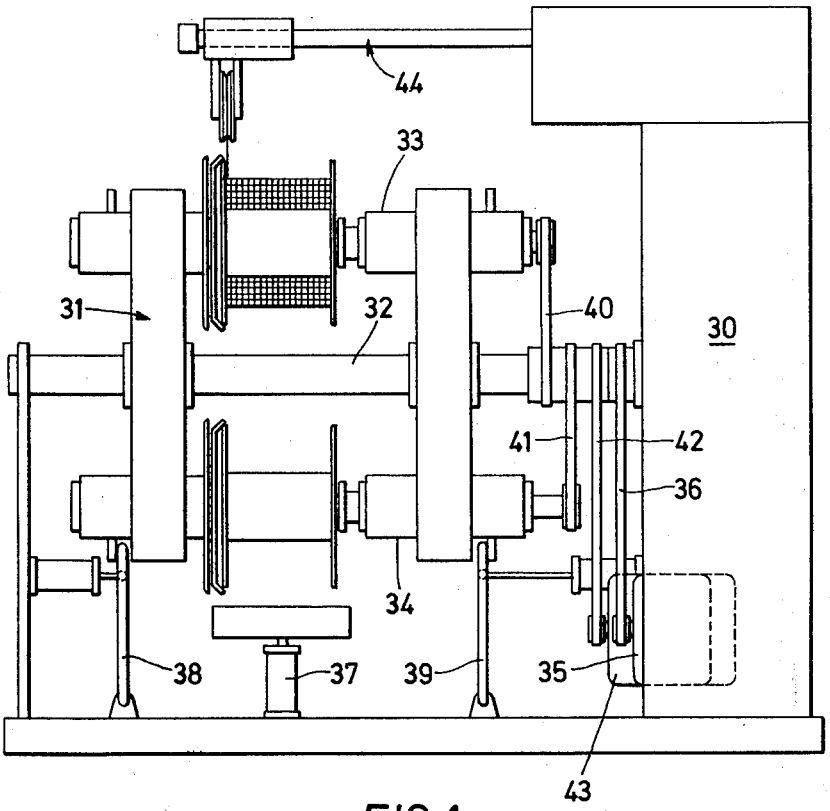
FIG. 1 is a simplified elevation of the winding machine.

A brief description will first be given of the winding machine on which the protective device is mounted. A rigid frame 30 (FIG. 1) bears a cage 31 comprising a shaft 32 pivoting on the frame 30. The cage 31 in turn bears two pairs of coaxial chucks 33 and 34 disposed in such a way that reels may be mounted between the two coaxial chucks of each pair. Belts 40, 41, and 42 and a motor 43 drive the reels in rotation via the driving chuck. A driving motor 35, connected to the shaft 32 by a belt 36, causes the cage 31 to rotate by 180° about its axis each time the reel situated at the top of the cage 31 reaches its final stage of winding. After the rotation of the cage 31, the full reel which is now situated at the bottom of the cage 31 is discharged onto a lift 37 after retraction of the chucks by means of control devices 38 and 39. The full reel is then taken away and replaced by an empty reel. A traverse mechanism 44, which will be described in more detail further on, guides the wire wound on the upper reel so as to distribute it in uniform layers.

Figure 2:
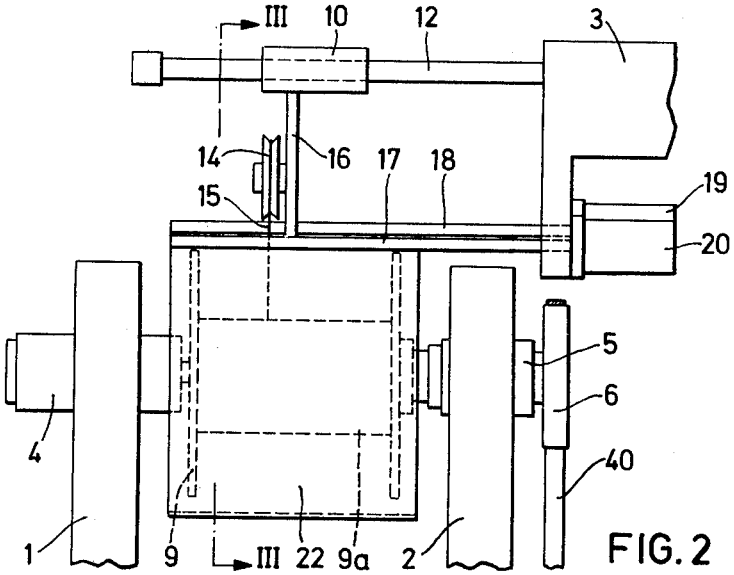
FIG. 2 is a partial elevation of the winding machine, viewed in the direction of the arrow A of FIG. 3, showing the protective means.

FIG. 2 shows two uprights 1 and 2 forming part of the cage 31 and the traverse mechanism borne by a support 3. The uprights 1 and 2 and equipped with chucks 4 and 5, one of which is provided with a driving pulley 6 rotated by the belt 40, while the other is controlled by a jack and is movable in the direction of its axis in order to release a reel 9 mounted between the tips of the chucks 4 and 5. The traverse mechanism comprises a carriage 10 guided by two fixed bars 11 and 12 disposed parallel to one another and secured to the support 3. The carriage 10 is movable longitudinally, i.e., in a direction parallel to the axis of the chucks 4 and 5, along the entire length of the reel 9. It is driven by a screw 13 mounted between the bars 11 and 12 and coupled to a motor accommodated in the support 3. The screw 13 engages a nut integral with the carriage 10. A traversing pulley 14 guides a wire 15 which comes from a production line and is led onto a drum **9*a* of the reel 9 driven in the direction indicated by an arrow B by the motor 43. The pulley 14 is carried by an arm 16 integral with the carriage 10 so that its axis of rotation is parallel to that of the reel 9 and so that it moves in the vicinity of the reel 9.**

Figure 3:
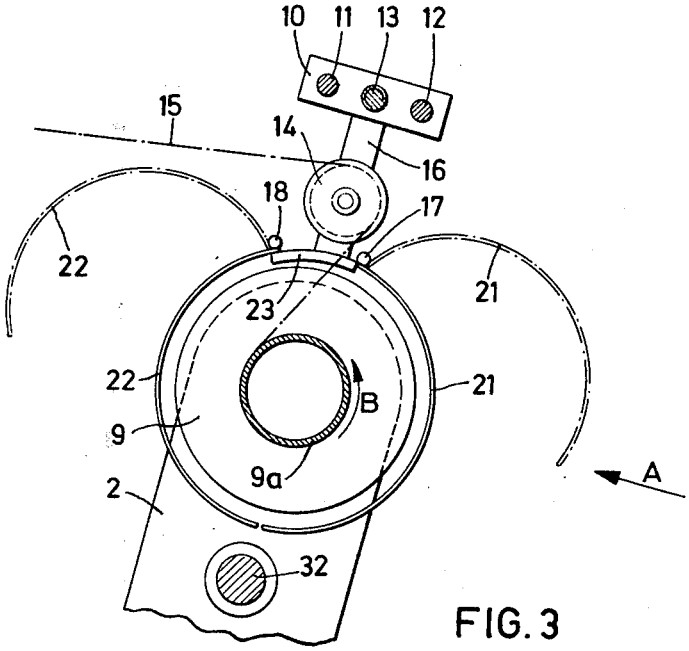
FIG. 3 is a section taken on the line III-III of FIG. 2.

The support 3 also carries two pivoting spindles 17 and 18 which are parallel to one another and to the axis of the reel 9. The two spindles 17 and 18 are situated spaced from one another below the pulley 14. They are connected to rotary-action jacks 19 and 20, the movable parts of which pivot about their axes alternately in one direction or the other through a given angle. Each of the spindles 17 and 18 bears a rectangular protective plate 21 and 22, respectively, bent into an arcuate shape. One of the edges of each of the plates 21 and 22 extends alongside the corresponding pivoting spindle, and the dimensions of these plates are such that when they are in the position shown in solid lines in FIG. 3, they together form a cylindrical jacket coaxial with the reel 9 and surrounding this reel almost completely, except for the space between the spindles 17 and 18.

Thus this space constitutes a longitudinal slot which, like the plates 21 and 22, is slightly longer than the length of the reel 9. It is important that the edges of the plates 21 and 22 opposite the spindles 17 and 18 should meet when the plates are in the closed position in order that the cylindrical surface formed by the plates may be as regular as possible.

Figure 4:
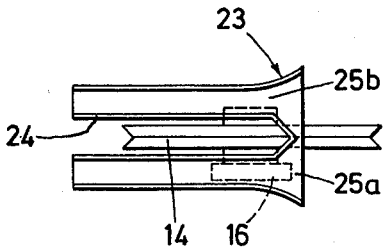
FIG. 4 is an inverted plan view on a larger scale showing the sliding protective member.

It will be realized that if the protective jacket formed by the plates 21 and 22 is closed during winding, the wire 15 passes through the slot between the spindles 17 and 18, all the while moving back and forth from one end of the slot to the other as the successive layers of wire are wound. If the wire should break, then no matter when that happens, the wire-tail, under the effect of centrifugal force, will follow along the inner surface of the jacket formed by the plates 21 and 22, which will to a certain extent prevent the broken end from lashing about and possibly damaging the layers of wire already wound. However, in passing through the slot between the spindles 17 and 18, the wire-tail will tend to be projected towards the outside, then returned towards the inside, and to undulate, thus being liable to touch the upper layer on the reel. In order to avoid this drawback, the protective device described is supplemented by a sliding protective member 23. This member is a sheet-metal part bent into an arcuate shape which is just slightly longer than the width of the slot between the spindles 17 and 18. It is fastened to the lower end of the arm 16. This sheet-metal part 23 is a little wider than the pulley 14 but has a central slot 24 which is of substantially the same width as the pulley 14. Moreover, both the edges of the slot 24 and the outer edges of the member 23 are bent back so as to define two parallel tracks of equal width running on each side of the plane of the pulley 14. As may be seen in FIG. 4, the front part of the slot 24 is likewise provided with bent edges forming a V-shaped deflection wall 25*a*, 25*b*. The member 23 widens out gradually at the end where the front of the slot 24 is situated. This front end of the member 23 is so disposed as to meet the edge of the plate 21, while the rear end of the member 23 slightly overlaps the inner surface of the plate 22. The member 23 prevents the broken end of the wire from rebounding in the manner described above. This broken end, which is slipping along on the plates 22 and 21 and which is contained in the plane of the pulley 14, will be picked up after one revolution by the deflecting wall 25*a*, 25*b* and led into one of the two curved tracks of the member 23 until it comes in contact with the protective plate 22. Hence the device described ensures continuous protection of the portion of the wire already wound until the reel can be halted.

The winding machine described is equipped with a device for detecting wire breakage. This device, known per se, is so arranged as to transmit a signal whenever the wire breaks. Inasmuch as the tension of the wire abruptly drops to zero in such an event, it is this parameter which may be utilized to control the appearance of the signal. Numerous means are known for continuously measuring the tension of a continuously moving wire and for causing a signal to be transmitted whenever there is any abrupt fluctuation of that tension. Devices of this kind are well known. They may, for example, comprise a pulley mounted on a lever acted upon by a spring, the pulley and the lever normally being held in a position where the spring is tensed by the pull which the wire exerts upon the pulley. This pulley may be situated just before the pulley 14, for example. As soon as the wire breaks, it no longer exerts any pull, and the lever pivots under the influence of the spring. It may be equipped with a contact which opens or closes when it moves, thus transmitting a signal through an electric circuit. The signal detecting the breakage of the wire will be supplied to the motor of the carriage 10 so as to stop it immediately and to keep the protective part in the plane of the last turn of wire wound on the reel 9.

Although the winding machine which has been described above is one with a rotary cage, the protective means consisting of the plates 21 and 22 may likewise be used with other winding machines. In the case of a double-reel winding machine with parallel reels, the traverse mechanism is mounted on a transfer carriage moving perpendicular to the axes of the reels so as to be positioned alternately above the one and then the other reel. In this case, the spindles 17 and 18 may be borne either by the transfer carriage, in which event only one pair of plates 21 and 22 will be necessary, or by the uprights supporting the chucks. In the latter case, two pairs of protective plates will be required, and the sliding protective member 23 carried by the traversing carriage will be arranged so as to be positioned alternately in one or the other of the slots defined by each pair of protective plates.

In the case of a winding machine where the two reels are coaxial and where the traversing carriage is movable parallel to the axis of the reels over a distance such that it can cover the two reels successively, two pairs of protective plates will preferably be provided, one pair associated with each reel.

In all the cases described above, the winding machine may additionally be equipped with protective channels surrounding the reels at one end so as to receive the end of the wire of the full reel after the transfer operation when the wire has been cut and seized by a hook rotating with the empty reel.

What is claimed is:

1. A winding machine for metal wire comprising: a support for at least one reel; means for driving said reel in rotation; guiding means including a traversing carriage bearing a pulley for guiding said wire as said wire is wound on said reel; and a protective device, to protect said reel in the event of wire breakage, including two protective plates of arcuate shape extending the entire length of said reel, at least one of said plates being hinged about an axis parallel to that of said reel and being movable between an open position and a closed position in which one of the edges of said one plate meets a corresponding edge of the other of said plates, the opposite edges of said two plates being spaced from one another so as to define a longitudinal slot between them, said slot being adapted to admit said wire when said protective device is in said closed position, and said protective device including a sliding protective member disposed in said slot, said sliding member being carried by said carriage and having a small opening situated in the plane of said pulley and adapted to admit said wire.

2. A winding machine for metal wire comprising: a rotatable support carrying two reels having their axis parallel to one another; means for driving each one of said reels in rotation; guiding means for guiding said wire as said wire is wound on one of said reels; means for rotating said support to successively displace said reels into a winding position in front of said guiding means; and a protective device to protect a reel which is in said winding position in the event of wire breakage, said device including two protective plates of arcuate shape hinged about an axis parallel to that of said reel in the winding position and movable between an open position in which said plates permit rotation of said support with the reels and a closed position in which said plates encircle said reel in the winding position, said plates extending the entire length of said reel and having one of their edges meeting each other in the closed position, and wherein the opposite edges of said plates are spaced from one another so as to define a longitudinal slot between them, said slot being adapted to admit said wire when said protective device is in said closed position.

3. A winding machine in accordance with claim 2, wherein said means for guiding comprises a traversing carriage bearing a pulley for guiding said wire, and wherein said carriage carries a sliding protective member disposed in said slot and having a small opening situated in the plane of said pulley and adapted to admit said wire.

4. A winding machine in accordance with claim 1, wherein said opening is bounded by a deflecting wall inclined with respect to said plane.

5. A winding machine in accordance with claim 1, wherein each of said two plates is hinged about a spindle disposed parallel to the axis of said reel.

6. A winding machine in accordance with claim 5, wherein said plates are controlled by jacks mounted on the body of said winding machine.

7. A winding machine in accordance with claim 5, wherein said spindles are respectively situated alongside said opposite edges.

* * * * *